US009598961B2

(12) United States Patent
Gurao et al.

(10) Patent No.: US 9,598,961 B2
(45) Date of Patent: Mar. 21, 2017

(54) GAS TURBINE SPINDLE BOLT STRUCTURE WITH REDUCED FRETTING FATIGUE

(71) Applicant: Siemens Energy, Inc., Orlando, FL (US)

(72) Inventors: Manish S. Gurao, Oviedo, FL (US); Kevin M. Light, Maitland, FL (US); Zafir A. M. Abdo, Orlando, FL (US); Kazim Ozbaysal, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 450 days.

(21) Appl. No.: 14/330,323

(22) Filed: Jul. 14, 2014

(65) Prior Publication Data

US 2016/0010481 A1 Jan. 14, 2016

(51) Int. Cl.

| | |
|---|---|
| ***F01D 5/06*** | (2006.01) |
| ***F01D 5/02*** | (2006.01) |
| ***F01D 11/02*** | (2006.01) |
| ***F04D 29/64*** | (2006.01) |
| ***F04D 29/054*** | (2006.01) |
| ***F01D 5/30*** | (2006.01) |

(52) U.S. Cl.

CPC ..... *F01D 5/066* (2013.01); *F01D 5/025* (2013.01); *F01D 5/30* (2013.01); *F01D 11/025* (2013.01); *F04D 29/054* (2013.01); *F04D 29/644* (2013.01); *F05D 2230/10* (2013.01); *F05D 2260/31* (2013.01); *F05D 2260/941* (2013.01); *F05D 2300/5021* (2013.01)

(58) Field of Classification Search

CPC . F01D 5/025; F01D 5/066; F01D 5/30; F01D 11/025; F04D 29/054; F04D 29/644; F05D 2230/10; F05D 2260/31; F05D 2260/941; F05D 2300/5021

See application file for complete search history.

(56) References Cited

U.S. PATENT DOCUMENTS

| | | | | |
|---|---|---|---|---|
| 2,650,017 | A | 8/1953 | Pedersen et al. | |
| 4,245,959 | A * | 1/1981 | Carreno | F01D 5/066 416/198 A |
| 6,095,751 | A * | 8/2000 | Hirokawa | F01D 5/066 415/114 |
| 6,524,061 | B1 * | 2/2003 | Hirokawa | F01D 5/084 277/630 |
| 6,991,429 | B2 | 1/2006 | Uematsu et al. | |
| 6,994,526 | B2 * | 2/2006 | Furman | B23P 9/00 416/244 A |
| 7,114,915 | B2 | 10/2006 | Uematsu et al. | |
| 7,267,527 | B2 * | 9/2007 | Fischer | F01D 5/066 415/199.5 |

(Continued)

*Primary Examiner* — John K Fristoe, Jr.
*Assistant Examiner* — Behnoush Haghighian

(57) ABSTRACT

A spindle bolt structure is provided in a gas turbine engine, and includes a pilot region located within a bolt hole extending through a seal disk. The pilot region includes a circumferential pilot ridge located adjacent to a downstream axial face of the seal disk and a circumferential trough portion located between a bolt shoulder and the pilot ridge. The trough portion defines a trough diameter that is less than a diameter of the bolt shoulder and less than a diameter of the pilot ridge. The bolt shoulder and pilot ridge are formed with an applied compressive residual stress and are positioned for engagement with the seal disk.

18 Claims, 5 Drawing Sheets

(56) References Cited

U.S. PATENT DOCUMENTS

| | | | | |
|---|---|---|---|---|
| 7,600,404 | B2 | 10/2009 | Prevey, III | |
| 8,465,259 | B2 * | 6/2013 | Light | F04D 29/054 416/198 A |
| 2009/0003968 | A1 * | 1/2009 | Tezuka | B23G 9/001 411/411 |
| 2009/0067947 | A1 * | 3/2009 | Ichiryu | F01D 5/066 411/427 |
| 2013/0115088 | A1 * | 5/2013 | Castan | F04D 29/054 416/204 A |
| 2015/0139782 | A1 * | 5/2015 | Janarthanan | F01D 11/001 415/116 |

* cited by examiner

GAS TURBINE SPINDLE BOLT STRUCTURE WITH REDUCED FRETTING FATIGUE

FIELD OF THE INVENTION

The present invention relates generally to rotor structures in gas turbine engines and, more particularly, to a rotor structure including a spindle bolt structure for reducing fatigue in turbine spindle bolts of gas turbine engines.

BACKGROUND OF THE INVENTION

Turbomachines, such as gas turbine engines, generally include a compressor section, a combustor section and a turbine section. A rotor is typically provided extending axially through the sections of the gas turbine engine and includes structure supporting rotating blades in the compressor and turbine sections. In particular, a portion of the rotor extending through the turbine section comprises a plurality of turbine disks joined together wherein each turbine disk is adapted to support a plurality of turbine blades. Similarly, a portion of the rotor extending through the compressor section comprises a plurality of compressor disks joined together wherein each compressor disk is adapted to support a plurality of compressor blades. The portions of the rotor in the turbine and compressor sections are connected by a torque tube.

In a known construction of the rotor, the turbine disks are joined together by a plurality of spindle bolts extending longitudinally through the turbine disks in the axial direction. The spindle bolts are subjected to stresses which may comprise preload stresses and stresses resulting from thrust, centrifugal force, and/or thermal effects.

SUMMARY OF THE INVENTION

In accordance with an aspect of the invention, a spindle bolt structure is provided in a gas turbine engine. The gas turbine engine comprises a rotor including a plurality of turbine disks for supporting rows of blades, a torque tube located on a compressor side of the turbine disks, and a seal disk located between the torque tube and a first stage turbine disk. The spindle bolt structure comprises a spindle bolt extending through the turbine disks and disposed offset from a rotational axis of the turbine disks. The seal disk includes an upstream axial face and an opposing downstream axial face, and a bolt hole extending between the upstream and downstream axial faces. The spindle bolt extends through the bolt hole and includes a bolt shoulder engaged on the seal disk within the bolt hole. A pilot region is formed on the spindle bolt and is located within the bolt hole for effecting a reduction in fretting fatigue of the spindle bolt. The pilot region includes a circumferential pilot ridge located in the bolt hole adjacent to the downstream axial face of the seal disk and a circumferential trough portion located between the bolt shoulder and the pilot ridge. The trough portion defines a trough diameter that is less than a diameter of the bolt shoulder and that is less than a diameter of the pilot ridge.

The diameter of the pilot ridge may be less than the diameter of the bolt shoulder. The diameter of the pilot ridge may be 0.1 mm less than the diameter of the bolt shoulder.

An axial length of the pilot ridge may be less than an axial length of the bolt shoulder and less than an axial length of the trough portion.

The bolt shoulder and the pilot ridge may be formed with an applied compressive residual stress. The compressive residual stress may include a subsurface compressive layer that is formed by a Low Plasticity Burnishing process. The compressive residual stress may form a compressive layer into the bolt shoulder and the pilot ridge to a depth of 0.2 mm or greater. A compressive residual stress of at least 200 ksi may be applied to the bolt shoulder and the pilot ridge.

The bolt shoulder and the pilot ridge can each define a smooth, mirror finish circumferential surface.

In accordance with another aspect of the invention, a spindle bolt structure is provided in a gas turbine engine. The gas turbine engine comprises a rotor including a plurality of turbine disks for supporting rows of blades, a torque tube located on a compressor side of the turbine disks, and a seal disk located between the torque tube and a first stage turbine disk. The spindle bolt structure comprises a spindle bolt extending through the turbine disks and disposed offset from a rotational axis of the turbine disks. The seal disk includes an upstream axial face and an opposing downstream axial face, and a bolt hole extending between the upstream and downstream axial faces. A bolt shoulder on the spindle bolt is located within the bolt hole, and the bolt shoulder is formed with an applied compressive residual stress and is positioned for engagement with the seal disk. The compressive residual stress effects a reduction in fretting fatigue of the spindle bolt at locations of contact between the bolt shoulder and the seal disk.

A pilot region may be formed on the spindle bolt and located within the bolt hole for effecting a reduction in fretting fatigue of the spindle bolt, the pilot region including a circumferential pilot ridge located in the bolt hole adjacent to the downstream axial face of the seal disk and a circumferential trough portion located between the bolt shoulder and the pilot ridge, the trough portion defining a trough diameter that is less than a diameter of the bolt shoulder and less than a diameter of the pilot ridge. The diameter of the pilot ridge may be less than the diameter of the bolt shoulder, and the pilot ridge may be formed with an applied compressive residual stress.

In accordance with a further aspect of the invention, a spindle bolt structure is provided in a gas turbine engine. The gas turbine engine comprises a rotor including a plurality of turbine disks for supporting rows of blades, a torque tube located on a compressor side of the turbine disks, and a seal disk located between the torque tube and a first stage turbine disk. The spindle bolt structure comprises a spindle bolt extending through the turbine disks and disposed offset from a rotational axis of the turbine disks. The seal disk includes an upstream axial face and an opposing downstream axial face, and a bolt hole extending between the upstream and downstream axial faces. The spindle bolt extends through the bolt hole and includes a bolt shoulder engaged on the seal disk within the bolt hole. A pilot region is formed on the spindle bolt and is located within the bolt hole. The pilot region includes a circumferential pilot ridge located in the bolt hole adjacent to the downstream axial face of the seal disk and includes a circumferential trough portion located between the bolt shoulder and the pilot ridge. The trough portion defines a trough diameter that is less than a diameter of the bolt shoulder and that is less than a diameter of the pilot ridge. The bolt shoulder and pilot ridge are formed with an applied compressive residual stress and are positioned for engagement with the seal disk. The compressive residual stress and the pilot region effect a reduction in fretting fatigue of the spindle bolt at locations of contact between the spindle bolt and the seal disk.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
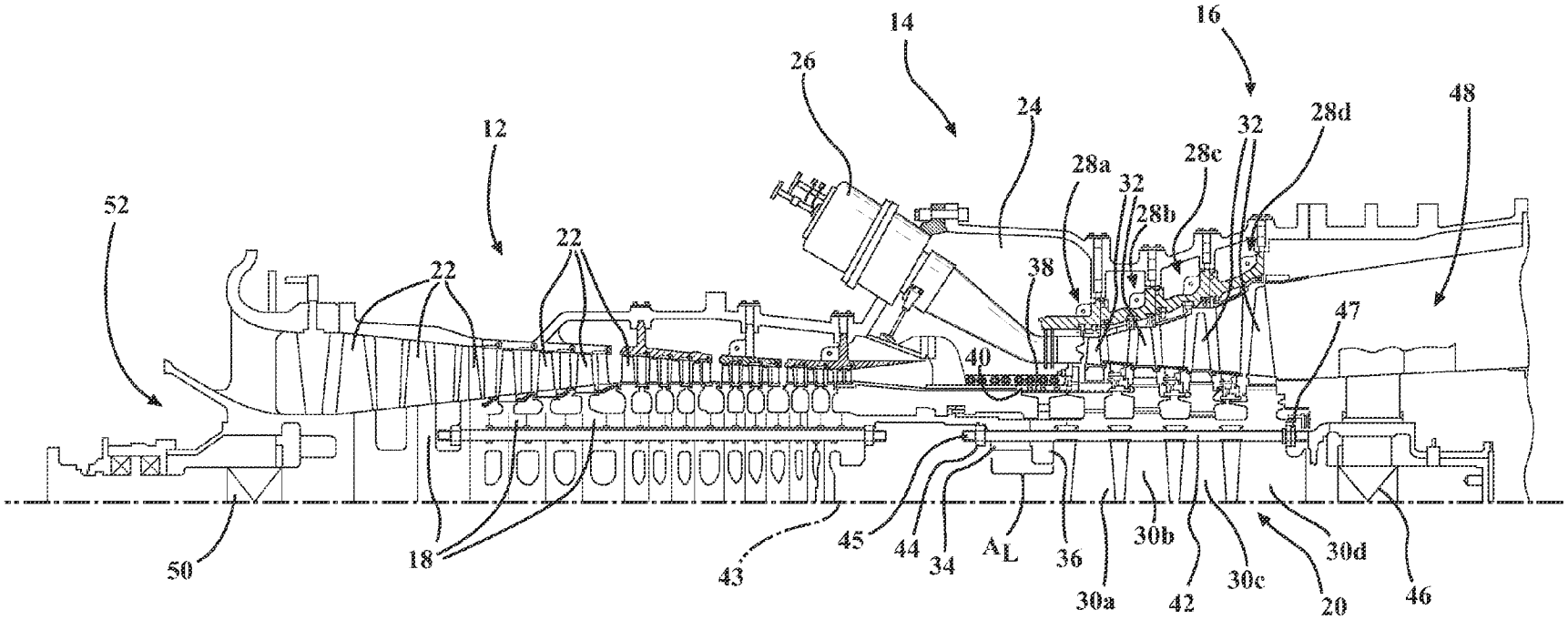
FIG. 1 is an elevational cross-section view of a gas turbine engine illustrating an area of potential spindle bolt failure determined in accordance with an aspect of the present invention.

Referring to FIG. 1, a gas turbine engine 10 is illustrated including a compressor section 12, a combustor section 14 and a turbine section 16. The compressor section 12 comprises a plurality of stages, each stage comprising a compressor disk 18 forming a portion of a rotor 20, and each compressor disk 18 supporting a row of compressor blades 22. Compressed exit air from the compressor section 12 is supplied to a combustor shell 24 of the combustor section 14 and is directed to a combustor 26 where the air is mixed with fuel and ignited to produce hot working gases for producing power in the turbine section 16.

The turbine section 16 includes a plurality of turbine stages, illustrated as first through fourth stages 28*a*, 28*b*, 28*c*, 28*d*. Each of the turbine stages 28*a*, 28*b*, 28*c*, 28*d* comprises a respective one of first through fourth turbine disks 30*a*, 30*b*, 30*c*, 30*d* that define a portion of the rotor 20, and each of the turbine disks 30*a*, 30*b*, 30*c*, 30*d* supports a plurality of blades 32 for converting the energy of the hot working gases into rotational movement of the rotor 20. The rotor 20 further comprises a torque tube 34 extending between the compressor section 12 and the turbine section 16 for transferring output power from the turbine section 16 to the compressor section 12, where a portion of the output power is used to drive the compressor disks 18 and blades 22, and the remaining portion of the output power is used to drive an output device, such as electrical generator (not shown) in a power generation plant.

In addition, the rotor 20 includes a seal disk 36 at a location between the turbine section 16 and the combustor section 14, supported between the first stage turbine disk 30*a* and the torque tube 34. The seal disk 36 includes a rotating seal 38 cooperating with a stationary seal structure 40 adjacent to the combustor shell 24 and forming a seal between the turbine section 16 and the combustor section 14.

A spindle bolt structure comprises a plurality of spindle bolts 42 (only one shown) that extend through the turbine disks 30*a-d*, and pass through the seal disk 36 and an end portion 80 (FIG. 2) of the torque tube 34. The spindle bolts 42 are disposed circumferentially around and are offset from a rotational axis 43 of the turbine disks 30*a-d*. The spindle bolts 42 include a first terminal end 45 adjacent the compressor side of the disks 30*a-d* at the torque tube 34, and an opposing second terminal end 47 adjacent an exhaust side of the turbine disks 30*a-d* wherein the first terminal end 45 typically includes a retaining nut 44 engaged against the end 80 of the torque tube 34 (see also FIG. 2). The spindle bolts 42 define a connecting structure spanning the turbine section 16 to join the turbine disks 30*a-d* of the portion of the rotor 20 extending through the turbine section 16. The rotor 20 is supported for rotation on a downstream bearing 46 adjacent to the fourth stage rotor disk 30*d* at an exhaust section 48 of the gas turbine engine 10, and is further supported for rotation on an upstream bearing 50 adjacent to an inlet section 52 of the engine 10.

In accordance with an aspect of the invention, it has been determined that a failure of a spindle bolt 42 may occur in existing turbine engines 10 having a rotor construction, such as is described above with reference to FIG. 1. Specifically, it has been determined that a failure of a spindle bolt 42 may occur in the area generally indicated along an incremental length section $F_A$ (FIG. 2), located within the seal disk 36.

Various factors are typically anticipated in specifying the design for the spindle bolts 42 in order to ensure that the spindle bolts 42 are capable of withstanding stresses exerted in the rotors 20. Such factors include possible effects from stresses induced by loads due to thrust, a centrifugal force, or thermal effects. In addition, a preload stress is typically present on the spindle bolts 42, which comprises a stress induced by a predetermined tension applied on the bolts 42 during assembly of the rotor 20 for maintaining the turbine disks 30*a-d*, seal disk 36 and torque tube 34 joined together.

Known design practice permits specification of the spindle bolts 42 to withstand the conventionally anticipated stresses experienced by the spindle bolts 42 as a result of forces generated by thrust, rotation of the rotor 20 and thermal effects, which are generally referenced herein as baseline or mean stresses. That is, the mean stresses generated by thrust, rotation of the rotor 20 and thermal effects, and substantially due to centrifugal forces with rotation of the rotor 20, are generally predictable, permitting the spindle bolts 42 to be designed, including a factor of safety, to withstand these predicted stresses.

The above noted area of potential failure in the spindle bolt 42, i.e., along the incremental length section $F_A$, indicates an area where a failure may occur in spite of the application of conventional design practice to configure the spindle bolts 42 to withstand the predicted stresses applied through the rotor 20. In accordance with the present invention, a theory of failure and solution are presented to address the unexpected spindle bolt failures at the exemplary location along the incremental length section $F_A$. Specifically, it may be observed that the rotor 20 normally experiences a sag between the bearings 46, 50, resulting in a certain amount of axial elongation of the spindle bolts 42 as the bolts 42 each rotate with the rotor 20 from top-dead-center (TDC) to bottom-dead-center (BDC). For example, a cyclically occurring bolt stretch or elongation can occur in the axial direction $A_1$ (FIG. 2) of the spindle bolt 42, extending from a stationary end at the nut 44 to a location generally adjacent to the downstream axial face 56 of the seal disk 36, as depicted by the axial length $A_L$ in FIGS. 1 and 2. The axial length section $A_L$ generally will exhibit a minimum axial elongation at TDC, and a maximum axial elongation at BDC.

It is believed that an aspect contributing to failure of the spindle bolt 42 comprises high cycle fatigue (HCF) that can result in a fretting effect (fretting fatigue) associated with the cyclically occurring lengthwise or axial movement of the spindle bolt 42 relative to the spindle bolt hole 58 in the seal disk 36 and the torque tube 34 as the length of the seal bolt 42 changes in the axial length section $A_L$. The fretting effect comprises an alternating stress, S, produced by high traction forces formed at an interface between the contacting surfaces of the spindle bolt 42 and the spindle bolt hole 58. Cracks at or near the surface of the spindle bolt 42 can propagate under HCF loading and can lead to the spindle bolt 42 eventually fracturing under tension due to the axial preload. In accordance with an aspect of the invention, it has been observed that a location of fretting fatigue, and potential failure, can occur along the incremental length section $F_A$ (FIG. 2) of the spindle bolt 42, located adjacent to the downstream axial face 56 of the seal disk 36.

Figure 3:
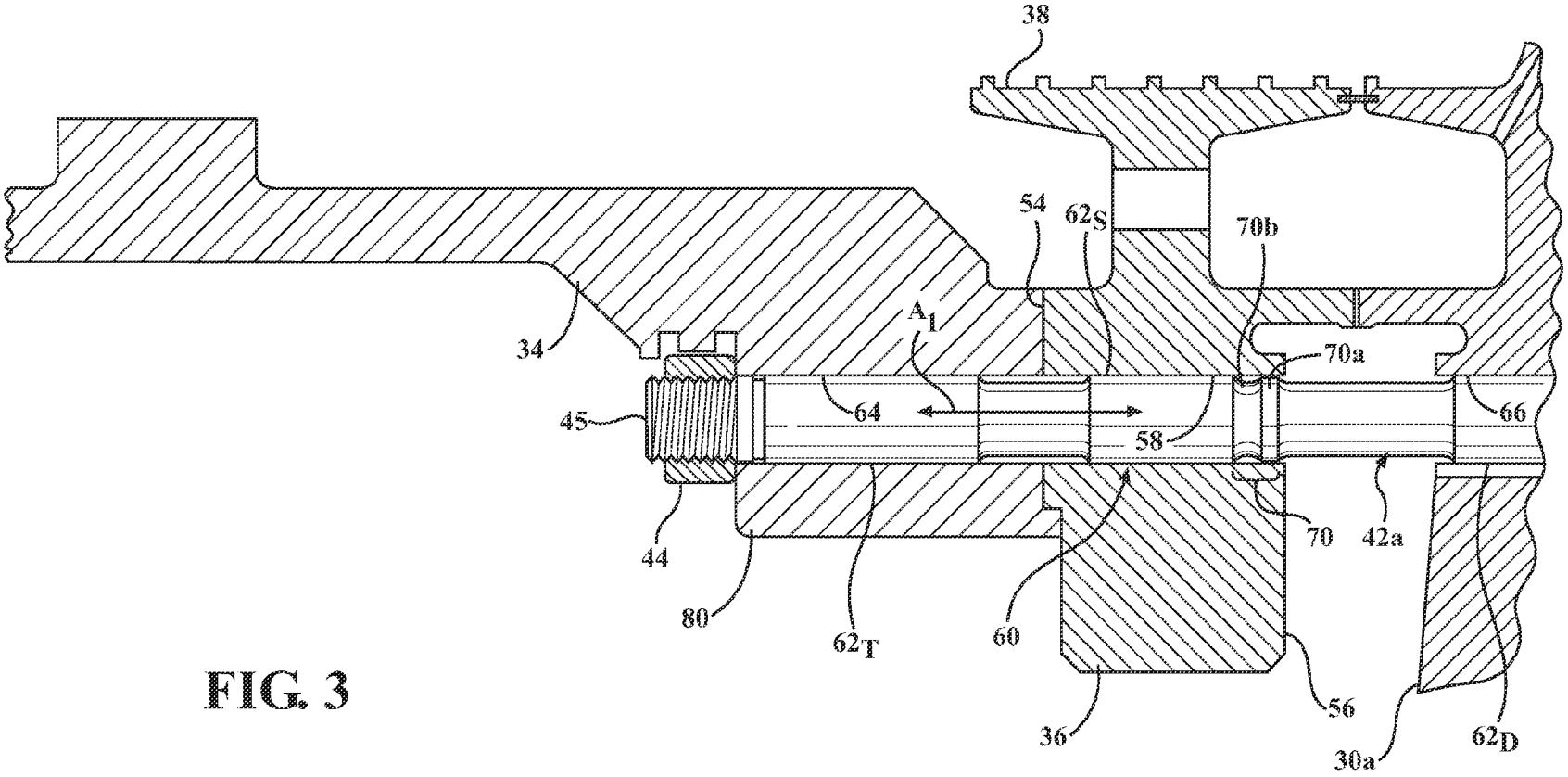
FIG. 3 is an elevational cross-section view of a seal disk portion of a rotor illustrating a spindle bolt structure in accordance with the present invention.
Figure 3A:
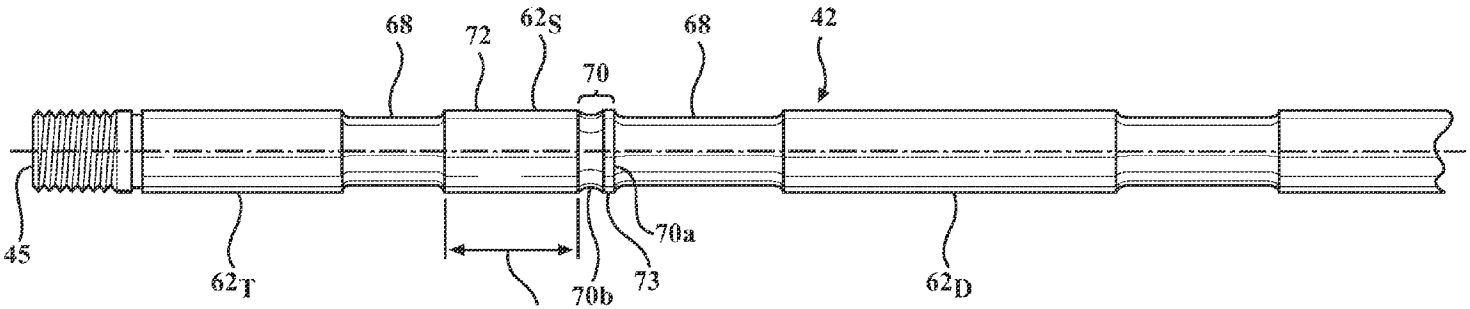
FIG. 3A is a side view of a seal disk end of a spindle bolt for the spindle bolt structure in accordance with the present invention.

Referring to FIGS. 3 and 3A, a spindle bolt structure 60 is illustrated including a modified spindle bolt 42*a* which is provided in accordance with the present invention to reduce the fatigue stress and associated crack propagation in the spindle bolt 42*a* that could be produced as a result of the relative movement between the surfaces of the spindle bolt 42*a* and the spindle bolt hole 58 defined in the seal disk 36. In particular, the spindle bolt 42*a* includes a bolt shoulder $\mathbf{62}_S$ forming a bolt surface sized to engage with a surrounding surface defined by the bolt hole 58 in the seal disk 36. FIG. 3 also illustrates a bolt shoulder $\mathbf{62}_T$ for cooperating within a bolt hole 64 in the torque tube 34, and a bolt shoulder $\mathbf{62}_D$ for cooperating within a bolt hole 66 in the first turbine disk 30*a*. The spindle bolt 42*a* additionally includes remaining bolt or shaft portions 68, hereinafter referred to as "shaft portions". The shaft portions 68 are formed with a reduced diameter, $D_4$, relative to the bolt shoulders $\mathbf{62}_T$, $\mathbf{62}_S$, $\mathbf{62}_D$. A shaft portion 68 extends between the pair of bolt shoulders $\mathbf{62}_T$, $\mathbf{62}_S$, located at an interface between the torque tube 34 and the disk seal 36, and a shaft portion 68 extends between the pair of bolt shoulders $\mathbf{62}_S$, $\mathbf{62}_D$, located in a space between the seal disk 36 and the first turbine disk 30*a*.

The spindle bolt 42*a* includes a pilot region 70 located axially within the bolt hole 58 for effecting a reduction in fretting fatigue of the spindle bolt 42*a*. The pilot region 70 includes a circumferential pilot ridge 70*a* located in the bolt hole 58 adjacent to the downstream axial face 56 of the seal disk 36, and a circumferential trough portion 70*b* located between the bolt shoulder $\mathbf{62}_S$ and the pilot ridge 70*a*.

Figure 2:
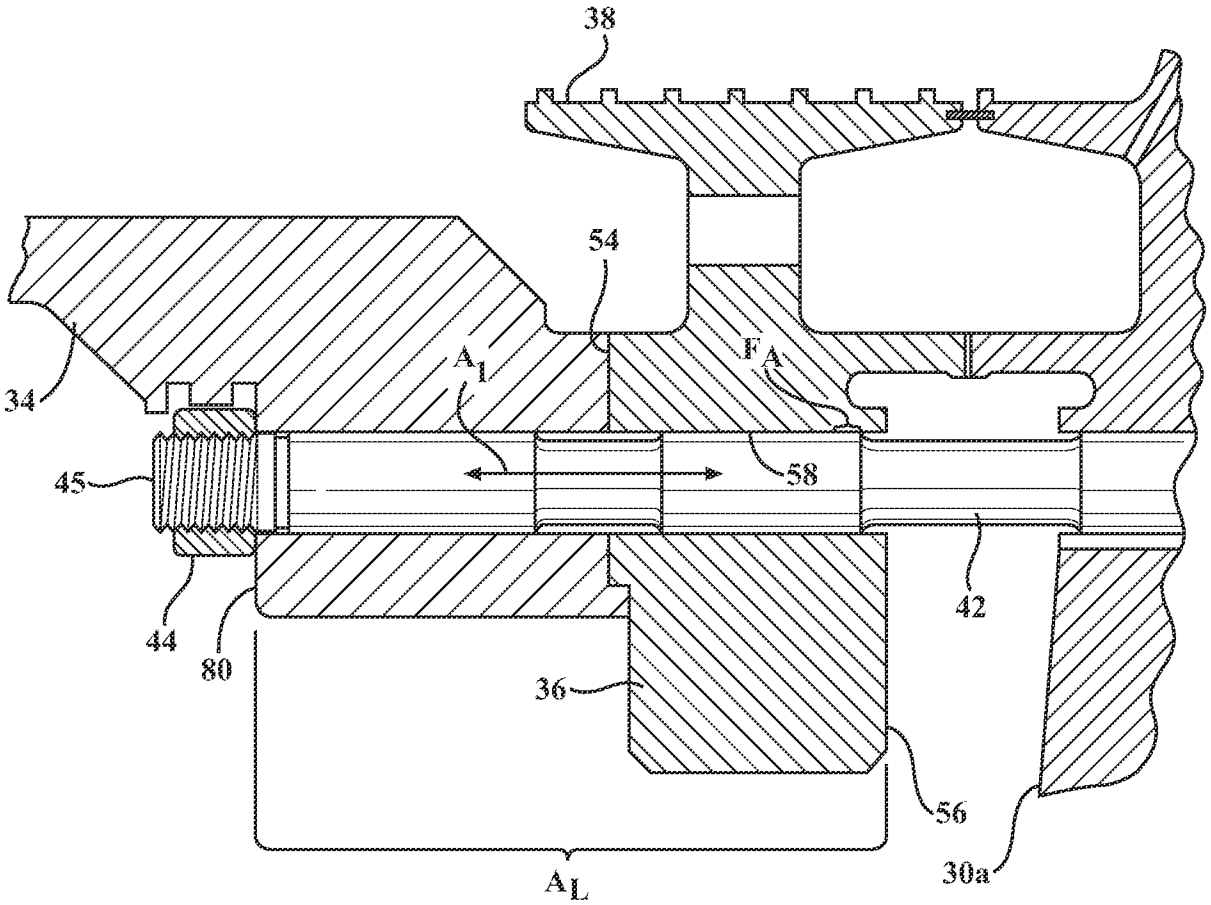
FIG. 2 is an enlarged elevational cross-section view of a seal disk portion of the rotor in the gas turbine engine of FIG. 1.
Figure 3B:
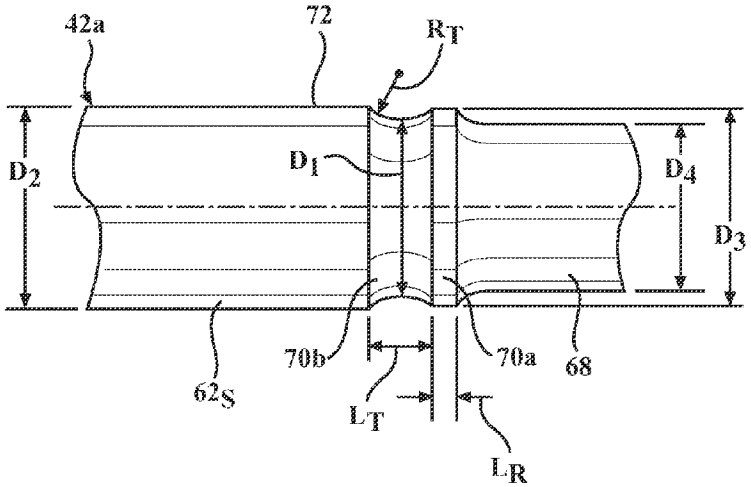
FIG. 3B is and enlarged view of a pilot portion of the spindle bolt shown in FIG. 3A.

Referring to FIG. 3B, the pilot region 70 is formed in the area of the bolt 42*a* corresponding to the incremental length section $F_A$, described above with reference to FIGS. 1 and 2. The trough portion 70*b* can be formed as an indentation extending radially inward from the outer surface 72 of the shoulder portion $\mathbf{62}_S$ and can define a radius $R_T$ lying in a plane extending parallel to the radial and axial directions. The radius $R_T$ can be slightly larger than the axial length $L_T$ of the trough portion 70*b*. The trough portion 70*b* defines a trough diameter $D_1$ that is less than a diameter $D_2$ of the bolt shoulder $\mathbf{62}_S$ and is less than a diameter $D_3$ of the pilot ridge 70*a* to form a region of the spindle bolt 42*a* that is spaced inward from contact with the seal disk 36 within the bolt hole 58.

In accordance with a further aspect of the invention, the diameter $D_3$ of the pilot ridge 70*a* is less than the diameter $D_2$ of the bolt shoulder $\mathbf{62}_S$. Preferably the diameter $D_3$ of the pilot ridge 70*a* is 0.1 mm less than the diameter $D_2$ of the bolt shoulder $\mathbf{62}_S$, where the bolt shoulder has a diameter of about 66 mm. Further, the pilot ridge is a relatively narrow feature having an axial length $L_R$ that is less than the axial length $L_T$ of the trough portion 70*b*, as well as less than an axial length $L_S$ (FIG. 3A) of the bolt shoulder $\mathbf{62}_S$.

The provision of the pilot region 70, and specifically the reduced diameter of the pilot ridge 70*a*, is believed to allow the spindle bolt 42*a* to accommodate a greater bending load resulting from thermal growth of the seal disk 36 and the adjacent first turbine disk 30*a*. In particular, the smaller diameter of the pilot ridge 70*a*, and the associated additional clearance to the seal disk surface within the bolt hole 58, allows the spindle bolt 42*a* to take more bending load and reduces the peak contact stress resulting from edge effect. That is, the provision of the pilot ridge 70*a* results in reduced localized contact locations, redistributing the contact load over a greater portion of the surface area of the bolt shoulder $\mathbf{62}_S$. Additionally, the increased contact area can result in lower membrane stress, i.e., an axial stress component, in the incremental length section $F_A$, and provides an improved safety margin by lowering the mean stress in the spindle bolt 42*a*.

Figure 4:
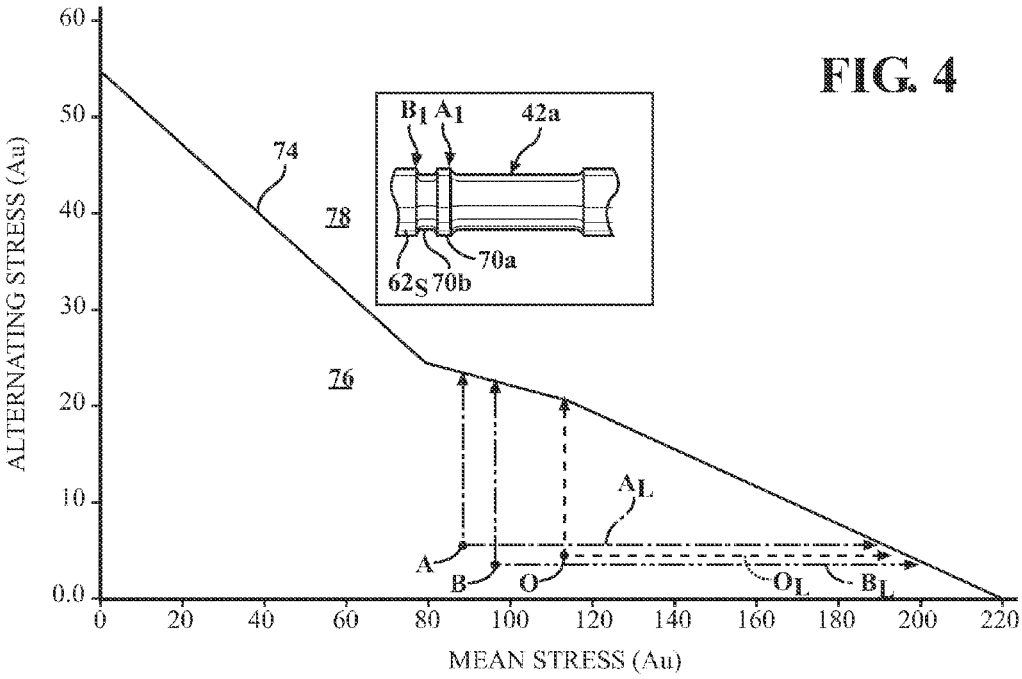
FIG. 4 is a modified Goodman diagram illustrating a comparison of stresses in the spindle bolt structure of FIG. 3 to the stresses in the spindle bolt structure of FIGS. 1 and 2.

FIG. 4 is a modified Goodman diagram illustrating a comparison of the mean stress in the spindle bolt 42 of FIG. 2, identified by data point O, and the mean stress in the spindle bolt 42*a* of the spindle bolt structure 60 in accordance with the present invention, as depicted by two data points A and B. Referring specifically to the diagram key in the upper portion of FIG. 4, the data point A corresponds to a stress measured at a location $A_1$ on the pilot ridge 70*a*, and the data point B corresponds to a stress measured at a location $B_1$ on the bolt shoulder $\mathbf{62}_S$ adjacent to the trough portion 70*b*. The axes of the diagram provide a comparison of the spindle bolt structures on a normalized basis of arbitrary units (Au). The line 74 comprises a separation line defining a separation between a safe zone of operation 76 below the line, and a dangerous zone of operation 78 above the line, where any data points depicting operation in the dangerous zone of operation 78 would indicate a likely failure of the component. The difference between the length of the arrows $A_L$ and $O_L$ represents the increase in the margin of safety of the mean stress at the location $A_1$, as provided by the spindle bolt construction 60 of the present invention. The difference between the length of the arrows $B_L$ and $O_L$ represents the increase in the margin of safety of the mean stress at the location $B_1$ provided by the spindle bolt construction 60 of the present invention. It can be seen that the present invention provides a substantial improvement (increase) in the margin of safety of the mean stress at both locations $A_1$ and $B_1$. It should be noted that the location of the line 74 may vary during operation of the gas turbine engine, for example by shifting to the left, and the additional margin of safety depicted by data points A and B represents a reduction in mean stress that is believed to ensure that the spindle bolt structure 60 remains in the safe operating zone 76 during varying operating conditions of the engine.

Figure 3C:
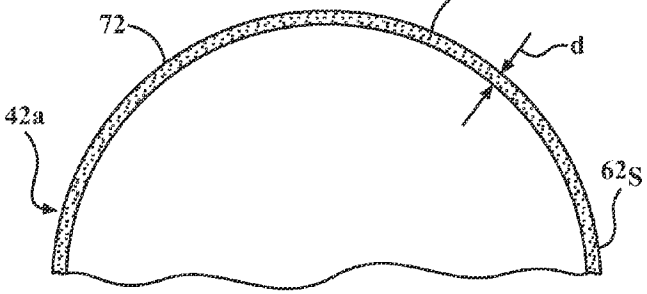
FIG. 3C is cross-sectional view through a bolt shoulder of the spindle bolt shown in FIG. 3A and illustrating a subsurface compressive layer.

Referring to FIG. 3C, the pilot ridge 70*a* and the bolt shoulder 70*b* can be formed with an applied compressive residual stress to define a subsurface compressive layer 82, where the thickness of the subsurface compressive layer 82 is shown exaggerated for illustrative purposes. The portion of the spindle bolt 42*a* illustrating the subsurface compressive layer in FIG. 3C comprises a section taken across the bolt shoulder $\mathbf{62}_S$. In accordance with an aspect of the invention, the subsurface compressive layer 82 is provided to increase the hardness in specific locations of contact between the spindle bolt 42*a* and the seal disk 36, increasing the resistance of the spindle bolt material to HCF crack initiation and decreasing damage from fretting and crack initiation.

In a preferred embodiment of the invention, the compressive residual stress is applied by a Low Plasticity Burnishing (LPB) process that can form the subsurface compressive layer 82 to a substantial distance below the outer surface 73 (FIG. 3A) of the pilot ridge 70*a* and below the surface 72 the bolt shoulder 70*b*. In particular, it may be understood that a substantial distance below the outer surface 72, 73 can be defined as a distance, d, of at least 0.2 mm below the outer surface 72, 73 and can extend up to a distance, d, of 1 mm below the outer surface 72, 73, providing substantial resistance to crack propagation.

In an exemplary embodiment, the compressive residual stress may be applied up to a value of at least 200 ksi, and to a depth of up to 1 mm to provide an optimal compressive layer 82 that can substantially lower crack initiation and propagation in the spindle bolt 42*a*. Further, below the compressive layer 82, the maximum residual tensile stress is preferably no more than 20 ksi, i.e., the residual tensile stress can equal 20 ksi or less.

Figure 5:
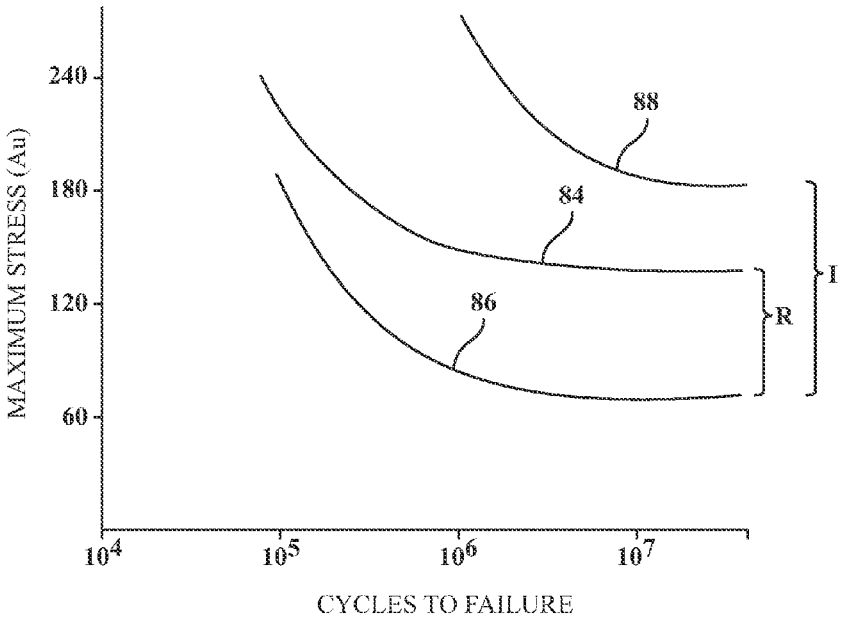
FIG. 5 is a diagram illustrating an improvement in the fatigue strength of the present spindle bolt structure, as provided by the subsurface compressive layer.

The diagram of FIG. 5 illustrates the change in the fatigue strength, represented by the "Maximum Stress" axis, of the spindle bolt 42*a* under different conditions related to fretting. The line 84 depicts a baseline change in maximum stress with cycles for the spindle bolt 42*a*, where the material of the spindle bolt 42*a* does not include any fretting. The line 86 depicts a predicted change in maximum stress with cycles for the spindle bolt 42*a*, where the material of the spindle bolt 42*a* includes fretting, and the bracket "R" represents a predicted reduction in fatigue strength. The line 88 depicts a predicted change in maximum stress with cycles for the spindle bolt 42*a*, where the material of the spindle bolt 42*a* has been provided with the compressive layer 82, and the bracket "I" represents a predicted improvement in fatigue strength over the spindle bolt 42*a* represented by line 86.

In addition to the above described improvements, the LPB process can provide a smooth, mirror finish to the outer surface 72, 73 of the spindle bolt 42*a* in the areas of contact within the bolt hole 58 of the seal disk 36. The smooth, mirror finish can provide a further resistance to HCF crack initiation. The LPB process can be performed by a burnishing or peening element that is brought into contact with the surface 72, 73 in a predetermined manner, such as a process performed by controlling the depth to which a surface treatment element, such as a burnishing or peening element, is impinged against the surface of the spindle bolt 42*a*. For example, the process for the forming the subsurface compressive layer 82 can be a process such as is described in U.S. Pat. No. 7,600,404, which patent is incorporated herein by reference in its entirety.

It may be understood that the pilot region 70 and the compressive layer 82, such as may be provided by the LPB process, are preferably provided to the spindle bolt 42*a* in combination. The combination of the spindle bolt 42*a* having the pilot region 70 and the compressive layer 82 can operate together to lower crack initiation under fretting in the area identified as subject to failure. Further, the improved surface finish lowers the probability of crack initiation from fretting, and the subsurface compressive stress field of the compressive layer 82 can stop crack propagation. The combined effects of the described aspects of the invention provide improved design safety margins for the spindle bolt 42*a*.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. In a gas turbine engine, a rotor including a plurality of turbine disks for supporting rows of blades, a torque tube located on a compressor side of the turbine disks, and a seal disk located between the torque tube and a first stage turbine disk, a spindle bolt structure comprising:

a spindle bolt extending through the turbine disks and disposed offset from a rotational axis of the turbine disks;

the seal disk including an upstream axial face and an opposing downstream axial face, and a bolt hole extending between the upstream and downstream axial faces;

the spindle bolt extending through the bolt hole and including a bolt shoulder engaged on the seal disk within the bolt hole;

a pilot region formed on the spindle bolt and located within the bolt hole for effecting a reduction in fretting fatigue of the spindle bolt, the pilot region including a circumferential pilot ridge located in the bolt hole adjacent to the downstream axial face of the seal disk and a circumferential trough portion located between the bolt shoulder and the pilot ridge, the trough portion defining a trough diameter that is less than a diameter of the bolt shoulder and that is less than a diameter of the pilot ridge.

2. The spindle bolt structure of claim 1, wherein the diameter of the pilot ridge is less than the diameter of the bolt shoulder.

3. The spindle bolt structure of claim 2, wherein the diameter of the pilot ridge is 0.1 mm less than the diameter of the bolt shoulder.

4. The spindle bolt structure of claim 1, wherein an axial length of the pilot ridge is less than an axial length of the bolt shoulder and less than an axial length of the trough portion.

5. The spindle bolt structure of claim 1, wherein the bolt shoulder and the pilot ridge are formed with an applied compressive residual stress.

6. The spindle bolt structure of claim 5, wherein the compressive residual stress includes a subsurface compressive layer that is formed by a Low Plasticity Burnishing process.

7. The spindle bolt structure of claim 6, wherein the compressive residual stress forms a compressive layer into the bolt shoulder and the pilot ridge to a depth of 0.2 mm or greater.

8. The spindle bolt structure of claim 6, wherein a compressive residual stress of at least 200 ksi is applied to the bolt shoulder and the pilot ridge.

9. The spindle bolt structure of claim 6, wherein the bolt shoulder and the pilot ridge each define a smooth, mirror finish circumferential surface.

10. In a gas turbine engine, a rotor including a plurality of turbine disks for supporting rows of blades, a torque tube located on a compressor side of the turbine disks, and a seal disk located between the torque tube and a first stage turbine disk, a spindle bolt structure comprising:

a spindle bolt extending through the turbine disks and disposed offset from a rotational axis of the turbine disks;

the seal disk including an upstream axial face and an opposing downstream axial face, and a bolt hole extending between the upstream and downstream axial faces; and a bolt shoulder on the spindle bolt located within the bolt hole, the bolt shoulder is formed with an applied compressive residual stress and is positioned for engagement with the seal disk, the compressive residual stress effecting a reduction in fretting fatigue of the spindle bolt at locations of contact between the bolt shoulder and the seal disk;

a pilot region formed on the spindle bolt and located within the bolt hole for effecting a reduction in fretting fatigue of the spindle bolt, the pilot region including a circumferential pilot ridge located in the bolt hole adjacent to the downstream axial face of the seal disk and a circumferential trough portion located between the bolt shoulder and the pilot ridge, the trough portion defining a trough diameter that is less than a diameter of the bolt shoulder and less than a diameter of the pilot ridge.

11. The spindle bolt structure of claim 10, wherein the compressive residual stress includes a subsurface compressive layer that is formed by a Low Plasticity Burnishing process.

12. The spindle bolt structure of claim 11, wherein the compressive residual stress extends radially into the bolt shoulder to a depth of 0.2 mm or greater.

13. The spindle bolt structure of claim 12, wherein a compressive residual stress of at least 200 ksi is applied to the bolt shoulder.

14. The spindle bolt structure of claim 10, wherein the diameter of the pilot ridge is less than the diameter of the bolt shoulder, and the pilot ridge is formed with an applied compressive residual stress.

15. In a gas turbine engine, a rotor including a plurality of turbine disks for supporting rows of blades, a torque tube located on a compressor side of the turbine disks, and a seal disk located between the torque tube and a first stage turbine disk, a spindle bolt structure comprising:

a spindle bolt extending through the turbine disks and disposed offset from a rotational axis of the turbine disks;

the seal disk including an upstream axial face and an opposing downstream axial face, and a bolt hole extending between the upstream and downstream axial faces;

the spindle bolt extending through the bolt hole and including a bolt shoulder engaged on the seal disk within the bolt hole;

a pilot region formed on the spindle bolt and located within the bolt hole, the pilot region including a circumferential pilot ridge located in the bolt hole adjacent to the downstream axial face of the seal disk and a circumferential trough portion located between the bolt shoulder and the pilot ridge, the trough portion defining a trough diameter that is less than a diameter of the bolt shoulder and less than a diameter of the pilot ridge; and the bolt shoulder and pilot ridge are formed with an applied compressive residual stress and are positioned for engagement with the seal disk, the compressive residual stress and the pilot region effecting a reduction in fretting fatigue of the spindle bolt at locations of contact between the spindle bolt and the seal disk.

16. The spindle bolt structure of claim 15, wherein the diameter of the pilot ridge is less than the diameter of the bolt shoulder.

17. The spindle bolt structure of claim 15, wherein the compressive residual stress includes a subsurface compressive layer that is formed by a Low Plasticity Burnishing process.

18. The spindle bolt structure of claim 15, wherein the bolt shoulder and the pilot ridge each define a smooth, mirror finish circumferential surface.

* * * * *